US008480550B2

(12) United States Patent
Taketsugu

(10) Patent No.: US 8,480,550 B2
(45) Date of Patent: Jul. 9, 2013

(54) NONCONFORMING PRODUCT REMOVING APPARATUS FOR USE WITH BOX MAKING MACHINE, AND BOX MAKING MACHINE

(75) Inventor: Masahiro Taketsugu, Hiroshima-ken (JP)

(73) Assignee: Mitsubishi Heavy Industries Printing & Packaging Machinery, Ltd., Hiroshima (JP)

( * ) Notice: Subject to any disclaimer, the term of this patent is extended or adjusted under 35 U.S.C. 154(b) by 311 days.

(21) Appl. No.: 12/679,838

(22) PCT Filed: Aug. 7, 2008

(86) PCT No.: PCT/JP2008/064196

§ 371 (c)(1),
(2), (4) Date: Mar. 24, 2010

(87) PCT Pub. No.: WO2009/041167

PCT Pub. Date: Apr. 2, 2009

(65) Prior Publication Data

US 2010/0210436 A1 Aug. 19, 2010

(30) Foreign Application Priority Data

Sep. 26, 2007 (JP) ..... 2007-249684

(51) Int. Cl.
*B31B 1/74* (2006.01)

(52) U.S. Cl.
USPC ..... 493/29; 493/12; 493/16; 53/53

(58) Field of Classification Search
USPC ..... 493/12, 16, 19, 20, 29; 53/53
See application file for complete search history.

(56) References Cited

U.S. PATENT DOCUMENTS 4,541,824 A * 9/1985 Muller ..... 493/29
4,704,034 A * 11/1987 Takenaka et al. ..... 356/429
4,998,910 A 3/1991 Mohaupt et al.

(Continued)

FOREIGN PATENT DOCUMENTS

EP 1588945 A1 10/2005
GB 2023104 12/1979

(Continued)

OTHER PUBLICATIONS

PCT/JP2008/064196 International Search Report mailed Sep. 2, 2008.

(Continued)

*Primary Examiner* — Thanh Truong
(74) *Attorney, Agent, or Firm* — Lowe Hauptman Ham & Berner, LLP

(57) ABSTRACT

A nonconforming product removing unit is disposed between a folding unit and a counter ejector of a box making machine, and includes a sort-out unit that conveys a corrugated board box whose joint is judged to be good by a judging unit to the counter ejector, and on the other hand discharges a corrugated board box whose joint is judged to be bad by the judging unit. Accordingly, only the conforming corrugated board box can be conveyed to the counter ejector. Therefore, the nonconforming board box can be removed easily, without requiring complicated work of taking out the nonconforming corrugated board box from among corrugated board boxes sorted into a predetermined number of batches by the counter ejector, and re-sorting only the conforming corrugated board boxes into a predetermined number of batches.

8 Claims, 13 Drawing Sheets

U.S. PATENT DOCUMENTS

| | | | | |
|---|---|---|---|---|
| 5,212,656 | A * | 5/1993 | Clary et al. | 702/84 |
| 5,342,278 | A * | 8/1994 | Kurandt | 493/16 |
| 5,493,104 | A * | 2/1996 | Wilson | 235/98 R |
| 5,978,499 | A | 11/1999 | Tossel et al. | |
| 5,993,367 | A * | 11/1999 | Hattori et al. | 493/12 |
| 6,323,502 | B1 * | 11/2001 | Battut | 250/559.19 |
| 6,935,998 | B2 * | 8/2005 | Silvestre | 493/405 |
| 2004/0154270 | A1 * | 8/2004 | Ishii et al. | 53/435 |
| 2011/0240706 | A1 | 10/2011 | Schwamberger et al. | |

FOREIGN PATENT DOCUMENTS

| | | |
|---|---|---|
| JP | 8103976 | 4/1996 |
| JP | 8165048 | 6/1996 |
| JP | 9-22464 | 1/1997 |
| JP | 2843783 B2 | 10/1998 |
| JP | 2006-069034 A | 3/2006 |

OTHER PUBLICATIONS

EP search report dated Dec. 16, 2011, corresponding to EP patent application No. 08792303.3.

Extended European Search Report in Application No. 12175058.2 mailed Aug. 31, 2012.

Korean Notice of Allowance for Application No. 10-2010-7000827 mailed Mar. 30, 2012.

Japanese Office Action for Application No. 2007-249684 mailed Oct. 9, 2013.

European Decision of Grant in European patent application No. 12175058.2 dated Feb. 12, 2013.

* cited by examiner

NONCONFORMING PRODUCT REMOVING APPARATUS FOR USE WITH BOX MAKING MACHINE, AND BOX MAKING MACHINE

RELATED APPLICATIONS

The present application is based on International Application PCT/JP2008/064196, filed Aug. 7, 2008 and claims priority from Japan Application Number 2007-249684, filed Sep. 26, 2007, the disclosures of which are hereby incorporated by reference herein in their entirety.

TECHNICAL FIELD

The present invention relates to a nonconforming product removing apparatus for use with a box making machine, the apparatus detecting and removing a nonconforming product of a box manufactured, and to the box making machine.

BACKGROUND ART

A general box making machine manufactures boxes (corrugated board boxes) by processing sheet materials (for example, corrugated board sheets), and includes a paper feeding unit, a printing unit, a slotter creaser, a folding unit, and a counter ejector. The paper feeding unit sends out corrugated board sheets stacked on a table one by one, and feeds them to the printing unit at a constant speed. The printing unit includes a print unit, and prints images on the corrugated board sheets. The slotter creaser performs processing of forming ruled lines as folding lines, grooves as flaps, and glue application tabs for jointing ends on the corrugated board sheets on which images are printed. The folding unit applies glue to the glue application tabs and folds, along the ruled lines, the corrugated board sheets being moved on which ruled lines, grooves, and glue application tabs are formed, and joints the glue application tabs to manufacture flat corrugated board boxes. The counter ejector stacks the corrugated board boxes formed by folding the corrugated board sheets and applying glue, sorts the corrugated board boxes into a predetermined number of batches and discharges them.

A corrugated board box manufactured by the box making machine turns out to be a distorted nonconforming product when a corrugated board box is assembled into a case with its joint not jointed to achieve a gap of a predetermined dimension between adjacent flaps. A conventional technique of inspecting conformity of a joint by detecting a dimension between edges of flaps of the joint includes the one disclosed in Patent Document 1.

[Patent Document 1] Japanese Patent No. 2843783

DISCLOSURE OF INVENTION

Problem to be Solved by the Invention

In the technique of Patent Document 1, a corrugated board box is conveyed to a counter ejector after a corrugated board sheet is folded by a folding unit and jointed at a joint, and conformity of the joint is inspected. Accordingly, because a corrugated board detected as a nonconforming product is sorted into a predetermined number of batches together with corrugated board boxes detected as conforming products, a batch including the nonconforming product ends up being treated wholly as nonconforming products even if the batch includes conforming products. Accordingly, complicated work of taking out the corrugated board box detected as a nonconforming product from among a predetermined number of batches sorted and discharged by the counter ejector, and re-sorting only corrugated board boxes of conforming products into a predetermined number of batches becomes necessary.

The present invention has been made in view of the problem described above, and an object of the present invention is to provide a nonconforming product removing apparatus for use with a box making machine, the apparatus enabling easy removal of only a nonconforming box, and the box making machine.

Means for Solving Problem

According to an aspect of the present invention, a nonconforming product removing apparatus for a box making machine including a folding unit that folds a sheet material to joint ends and form a box, and a counter ejector that discharges such boxes in a predetermined number, includes: an inspection item detecting unit that performs detection depending on an inspection item of the sheet material or the box; a judging unit that judges conformity of the sheet material or the box depending on a detection result obtained by the inspection item detecting unit; and a sort-out unit that is disposed between the folding unit and the counter ejector, conveys a box judged to be a conforming product by the judging unit to the counter ejector, and discharges a box judged to be a nonconforming product by the judging unit.

Because the nonconforming product removing apparatus for use with a box making machine is disposed between the folding unit and the counter ejector of the box making machine and includes the sort-out unit that conveys boxes judged to be conforming products by the judging unit to the counter ejector and that discharges a box judged to be a nonconforming product by the judging unit, only conforming boxes can be conveyed to the counter ejector. Accordingly, a nonconforming box can be removed easily without requiring complicated work of taking out the corrugated board box detected as a nonconforming product from among a predetermined number of batches sorted by the counter ejector, and re-sorting only conforming corrugated board boxes into a predetermined number of batches.

Advantageously, in the nonconforming product removing apparatus for a box making machine, the inspection item detecting unit detects at least one of a conveyance interval of such boxes, a feeding angle of the box, a printing position of the box, a front-back arrangement of the box, presence of a box opening cut, a glue-application state, and attachment of dust to a glue-applied part.

Because the nonconforming product removing apparatus for use with a box making machine detects at least one of a conveyance interval of boxes, a feeding angle of the boxes, a printing position of the boxes, a front-back arrangement of the boxes, presence of a box opening cut, a glue-application state, and attachment of dust to a glue-applied part as inspection items, only conforming boxes can be conveyed to the counter ejector according to the inspection items.

Advantageously, in the nonconforming product removing apparatus for a box making machine, the counter ejector includes a reshaping unit that reshapes a box, the inspection item detecting unit forms a joint detecting unit that detects a dimension of a gap of a joint of the box before reshaping, and the judging unit compares a reference interval of a joint of the box before reshaping as set based on prediction from the box after reshaping with a detection result obtained by the joint detecting unit, and judges conformity of the box before reshaping.

With the nonconforming product removing apparatus for use with a box making machine, the judging unit compares a reference interval of a joint of a box before reshaping by the reshaping unit included in the counter ejector as set based on prediction from a box after reshaping with a detection result obtained by the joint detecting unit, and judges conformity of the box before reshaping. Accordingly, the conformity of a joint of a box can be judged precisely even if the nonconforming product removing apparatus is disposed between the folding unit and the counter ejector of the box making machine.

Advantageously, in the nonconforming product removing apparatus for a box making machine, the sort-out unit includes a plurality of supporting members having different lengths in a conveyance direction provided movably between a conveyance position along a bottom surface of a box conveyed from the folding unit to the counter ejector and a discharge position at which the support members tilted downward about a same shaft disposed upstream in the conveyance direction, and when a box judged to be a nonconforming product is discharged, the supporting members are moved simultaneously to the discharge position, and are moved to the conveyance position starting with a shortest one of the supporting members along with passage of the box.

With the nonconforming product removing apparatus for use with the box making machine, the sort-out unit includes a plurality of supporting members having different lengths in a conveyance direction provided movably between a conveyance position along a bottom surface of a box conveyed from the folding unit to the counter ejector and a discharge position at which the support members tilted downward about the same shaft disposed upstream in the conveyance direction. When a box judged to be a nonconforming product is discharged, the supporting members are moved simultaneously to the discharge position, and are moved in the conveyance direction starting with the shortest supporting member along with passage of the box. Accordingly, because a box conveyed next to the nonconforming box can be supported by the supporting member having been moved to the conveyance position, the conveyance interval of the boxes can be shortened to increase the manufacturing process speed.

To achieve the object described above, the box making machine according to the present invention includes a folding unit that folds a sheet material, joints ends, and forms a box, and a counter ejector that discharges such boxes in a predetermined number, and includes any one of the nonconforming product removing apparatus explained above.

This box making machine includes the folding unit that folds a sheet material, joints ends, and forms a box, and the counter ejector that discharges the boxes in a predetermined number, and includes any one of the nonconforming product removing apparatus explained above. Accordingly, a nonconforming box can be removed easily, and the conformity of a joint of a box can be judged precisely even if the nonconforming product removing apparatus is disposed between the folding unit and the counter ejector, and the conveyance interval of boxes can be shortened to increase the manufacturing process speed.

Effect of the Invention

The present invention enables easy removal of a nonconforming box.

EXPLANATIONS OF LETTERS OR NUMERALS

Figure 1:
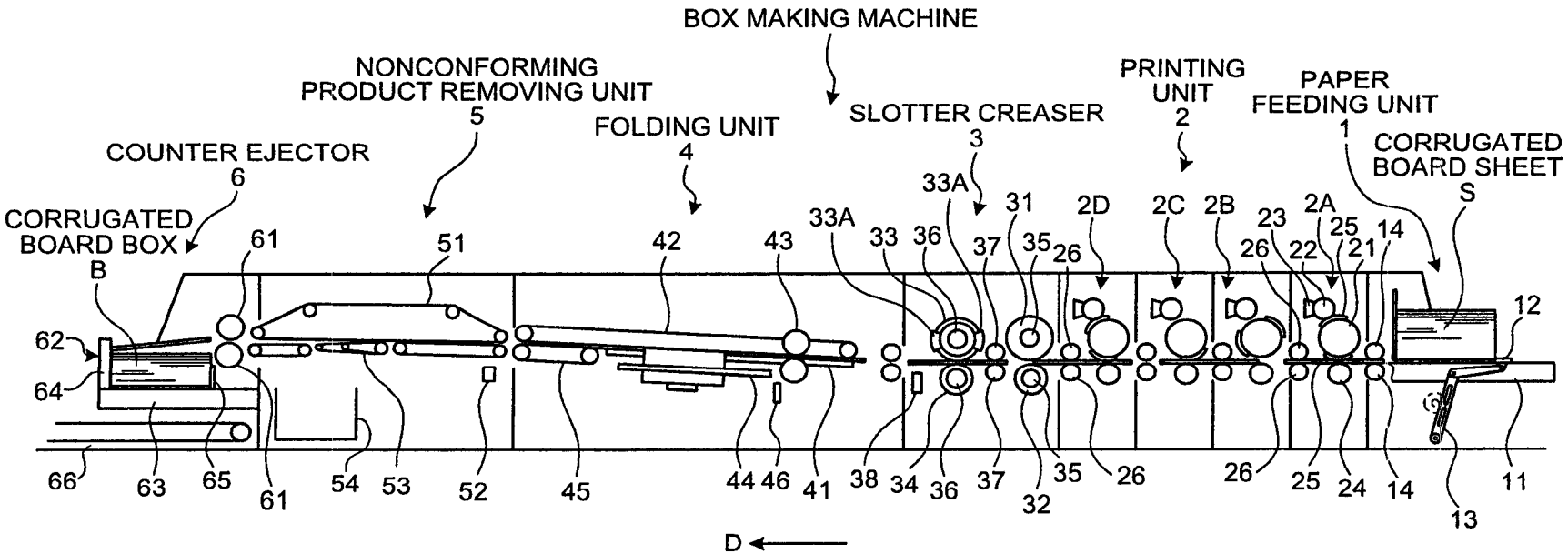
FIG. 1 is a schematic of an embodiment of a box making machine according to the present invention.

4 folding unit
5 nonconforming product removing unit (nonconforming product removing apparatus)
51 conveying unit
511 upper conveying belt
511A driving motor
512 (512A, 512B, 512C, 512D) lower conveying belt
512E driving motor
513 roller
514 suction box
514A suction device
515 roller
516 pressing device
52 joint detecting unit
521 light source
522 camera
523 positioning device
53 sort-out unit
531 (531A, 531B) selective conveying belt
532 first separating mechanism
532A rotating member
532B arm member
533 second separating mechanism
533A rotating member
533B arm member
534A, 534B roller
535 swinging mechanism
535A, 535B driving motor
536 driving motor
537 frame
538 rail
539 positioning device
54 receiving unit
541 discharging conveyer
55 passage detecting unit

56 controlling device
57 drive controlling unit
58 memory unit
59 judging unit
6 counter ejector
64 butting plate (reshaping unit)
65 angle fixing plate (reshaping unit)
405 gap
B corrugated board box (box)
S corrugated board sheet (sheet material)
D conveyance direction

BEST MODE(S) FOR CARRYING OUT THE INVENTION

Suitable embodiments of a nonconforming product removing apparatus for use with a box making machine, and a box making machine according to the present invention are explained in detail with reference to the attached drawings. The present invention is not limited by the embodiments.

Figure 2:
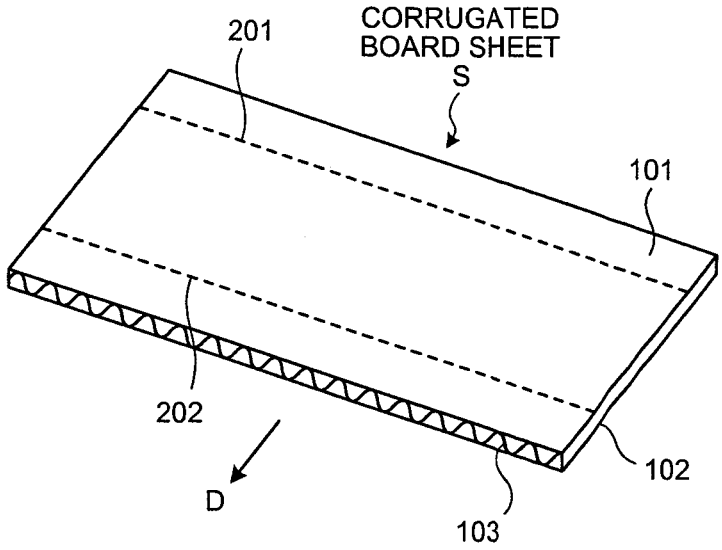
FIG. 2 is a perspective view of a corrugated board sheet before processing.
Figure 3:
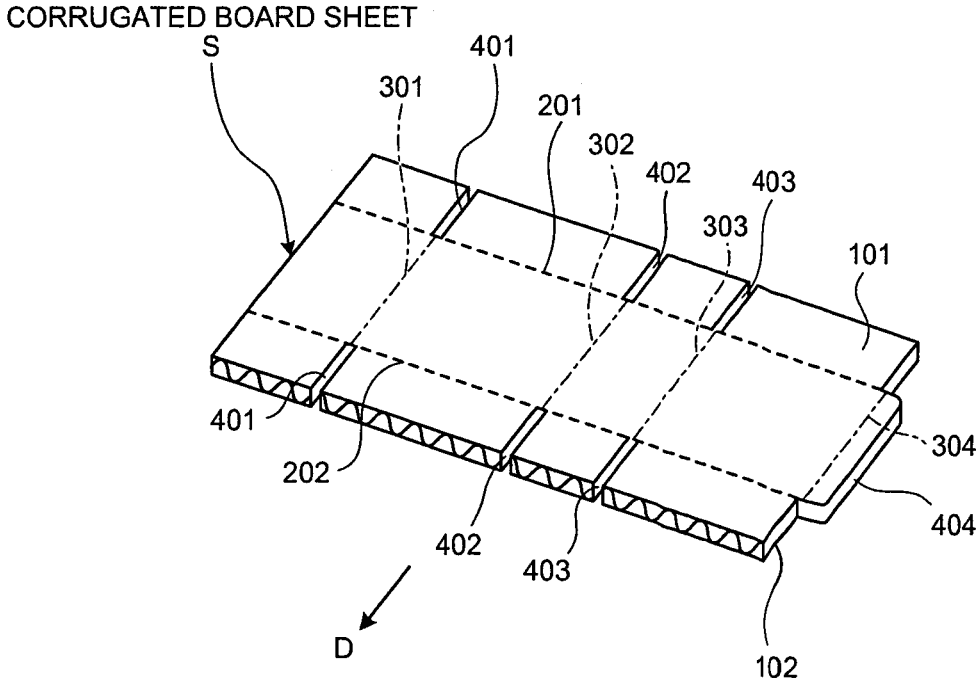
FIG. 3 is a perspective view of a corrugated board sheet after line process and grooving process.
Figure 4:
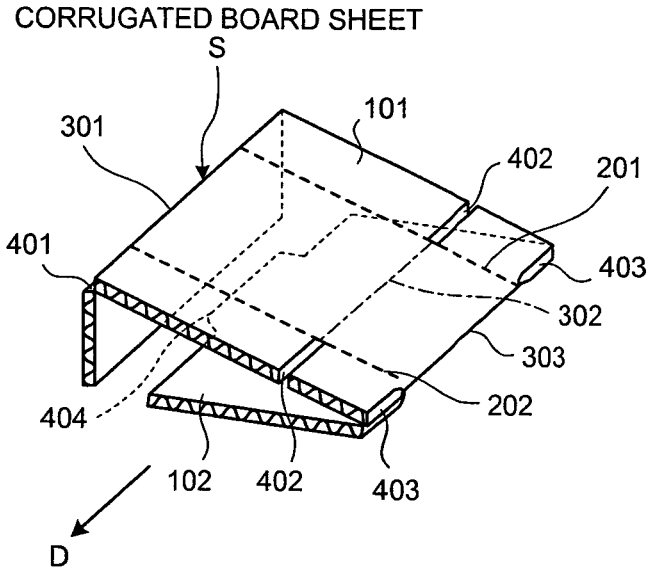
FIG. 4 is a perspective view of a corrugated board sheet during folding.
Figure 5:
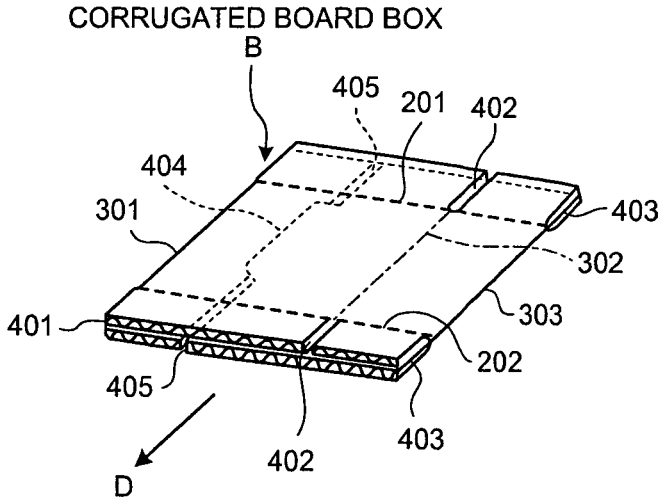
FIG. 5 is a perspective view of a folded and jointed corrugated board box.
Figure 6:
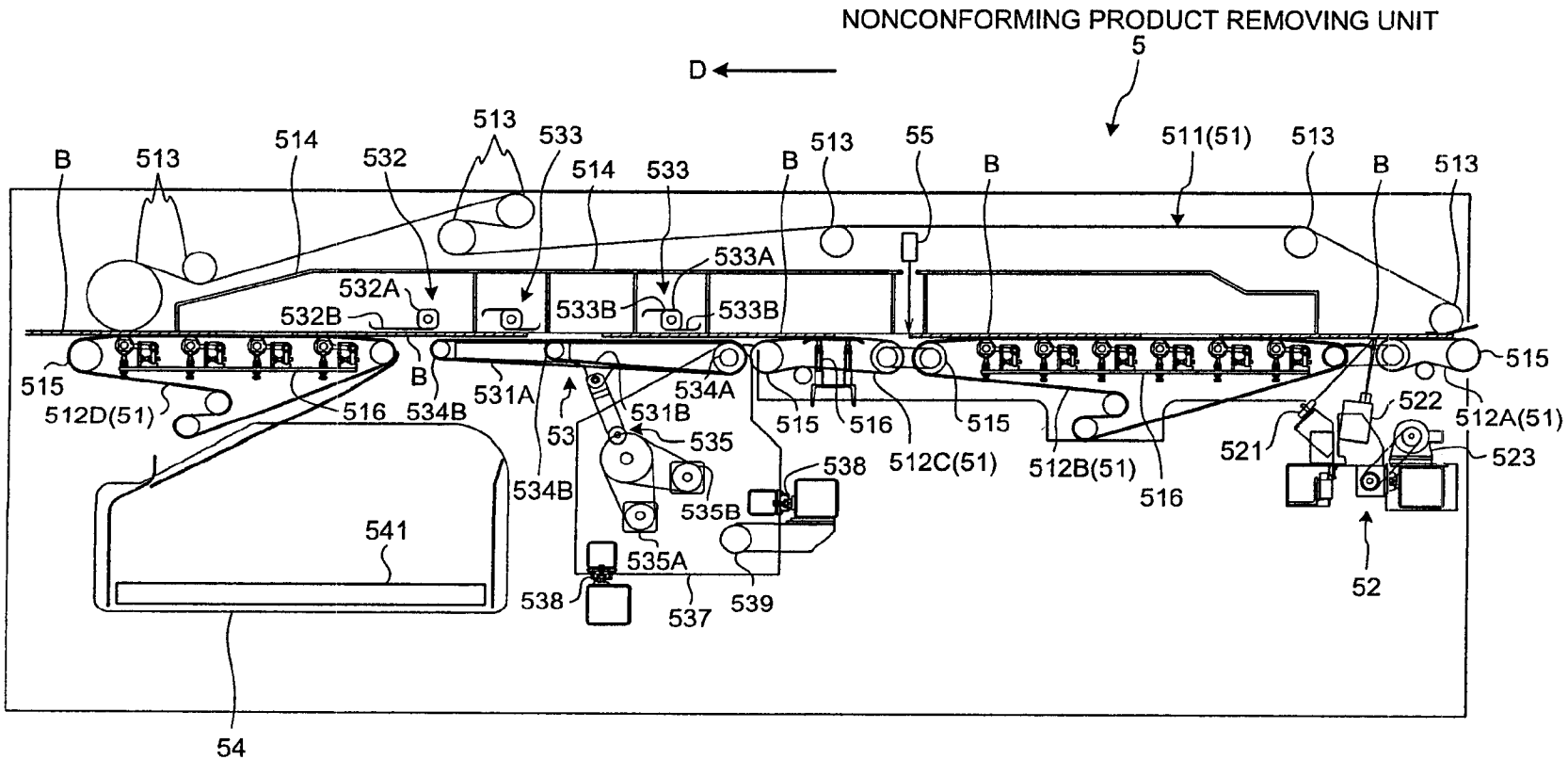
FIG. 6 is a schematic of an embodiment of a nonconforming product removing apparatus for use with the box making machine shown in FIG. 1.
Figure 7:
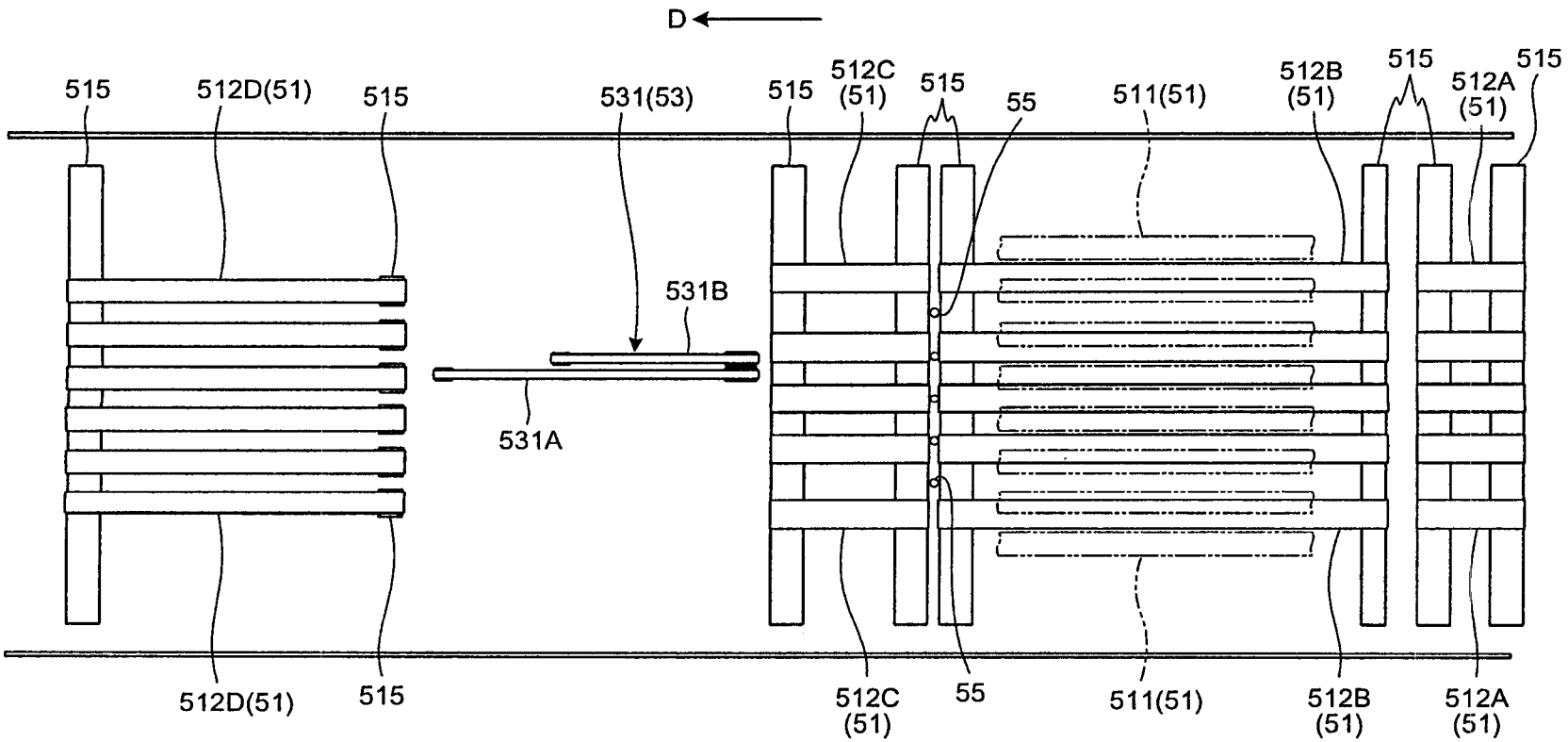
FIG. 7 is a plan view of the nonconforming product removing apparatus shown in FIG. 2.
Figure 8:
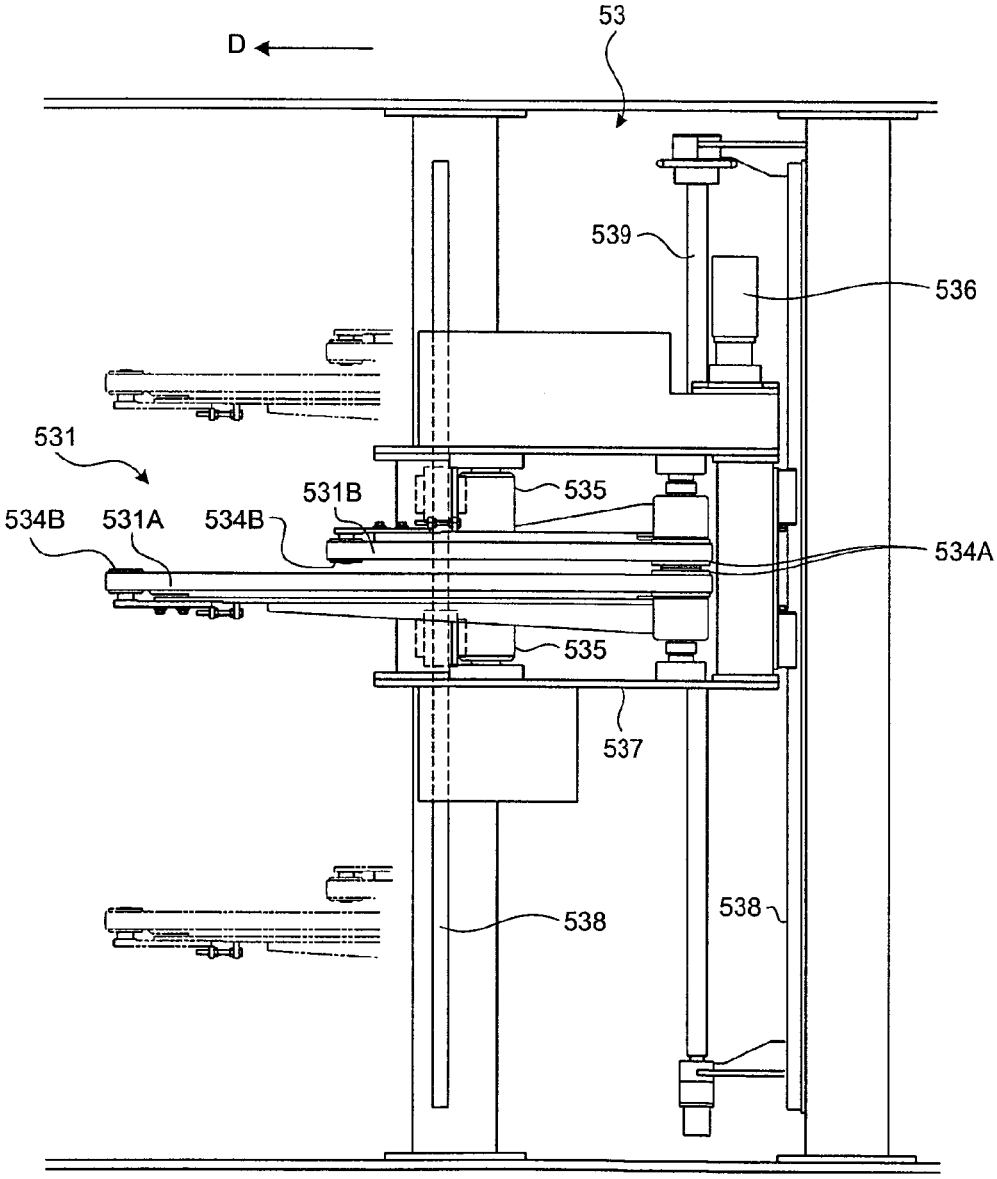
FIG. 8 is a plan view of a sort-out unit of the nonconforming product removing apparatus shown in FIG. 2.
Figure 9:
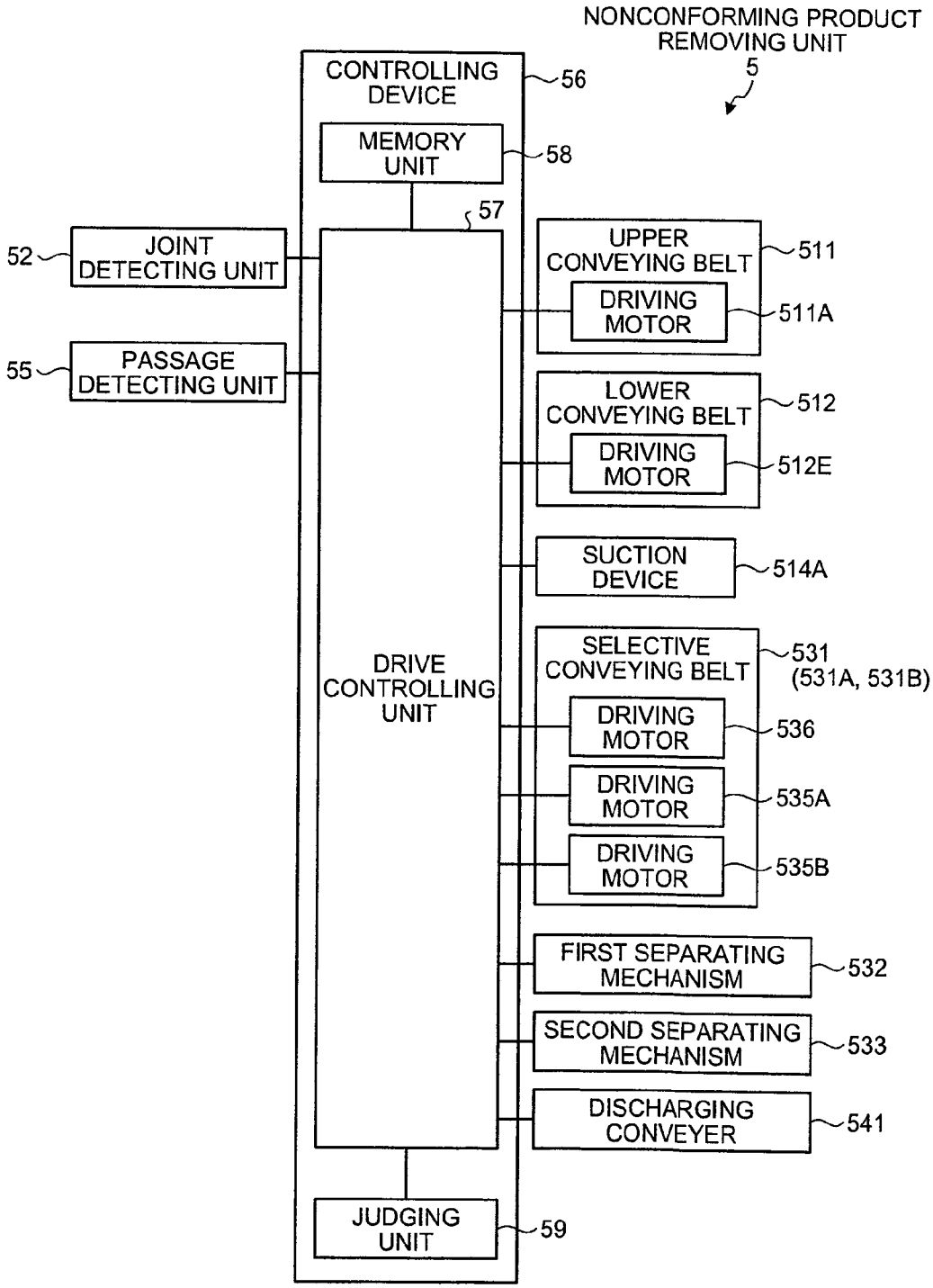
FIG. 9 is a block diagram of a control system of a nonconforming product removing apparatus.
Figure 10:
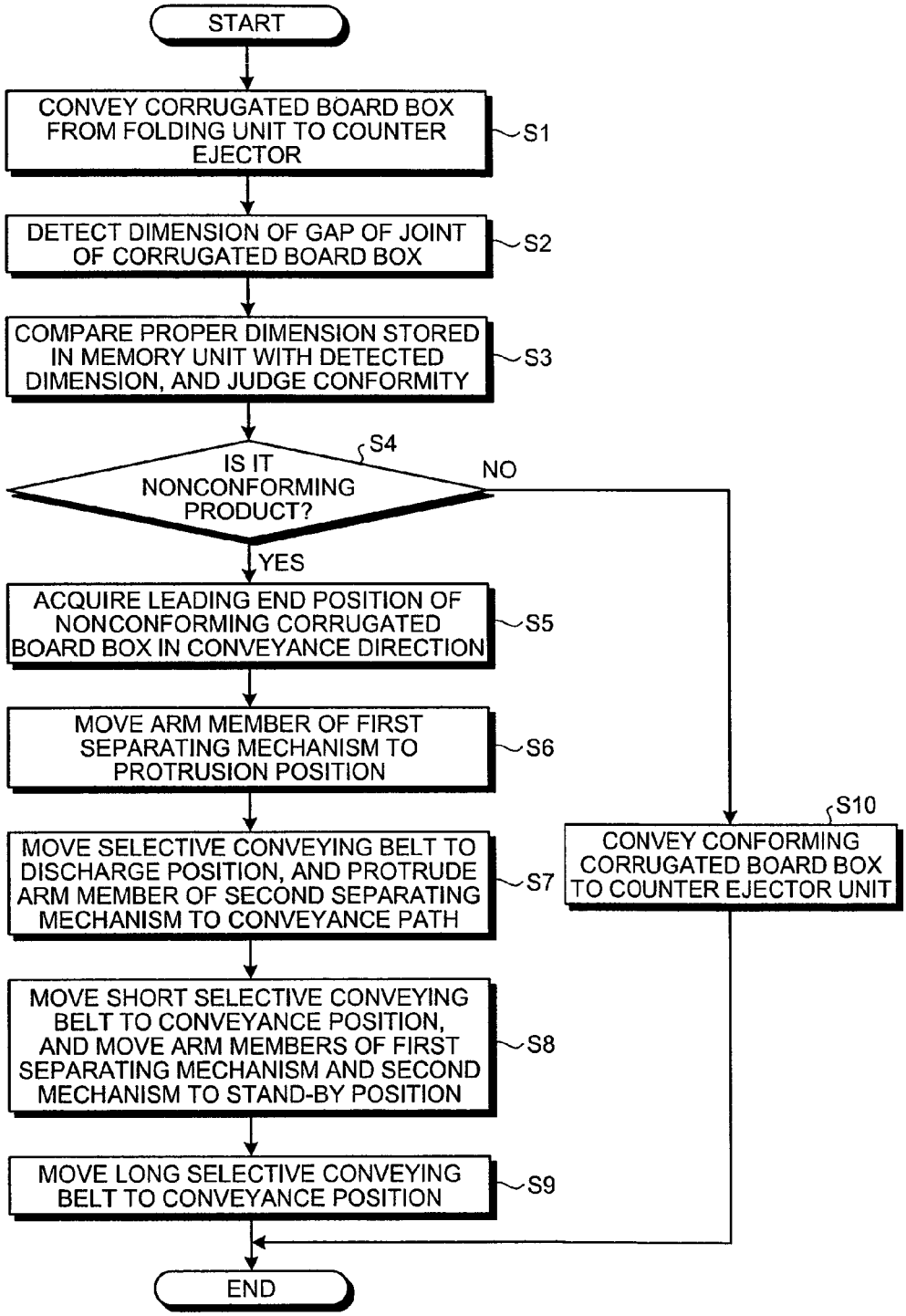
FIG. 10 is a flowchart of operation performed by a nonconforming product removing apparatus.

FIG. 1 is a schematic of an embodiment of a box making machine according to the present invention. FIG. 2 is a perspective view of a corrugated board sheet before processing. FIG. 3 is a perspective view of a corrugated board sheet after creasing process and slotting process. FIG. 4 is a perspective view of a corrugated board sheet during folding. FIG. 5 is a perspective view of a folded and jointed corrugated board box. FIG. 6 is a schematic of an embodiment of a nonconforming product removing apparatus for use with the box making machine shown in FIG. 1. FIG. 7 is a plan view of the nonconforming product removing apparatus shown in FIG. 2. FIG. 8 is a plan view of a sort-out unit of the nonconforming product removing apparatus shown in FIG. 2. FIG. 9 is a block diagram of a control system of a nonconforming product removing apparatus. FIG. 10 is a flowchart of operation performed by a nonconforming product removing apparatus. FIGS. 11 to 15 are schematics of operation performed by a nonconforming product removing apparatus.

A box making machine according to the present embodiment manufactures corrugated board boxes (box) B by processing corrugated board sheets (sheet materials) S, and includes, as shown in FIG. 1, a paper feeding unit 1, a printing unit 2, a slotter creaser 3, a folding unit 4, a nonconforming product removing unit (nonconforming product removing apparatus) 5, and a counter ejector 6 all of which are arranged in series in a direction of conveyance of the corrugated board sheet S.

The paper feeding unit 1 sends out the corrugated board sheets S one by one, and feeds them to the printing unit 2 at a constant speed. The paper feeding unit 1 includes a table 11 on which a number of the corrugated board sheets S is stacked and placed, a kicker 12 provided slidably in the direction of feeding the corrugated board sheets S on the top surface of the table 11, a crank lever mechanism 13 that reciprocates the kicker 12, and upper and lower feeding rolls 14 that send out the corrugated board sheets S.

The printing unit 2 includes four print units 2A, 2B, 2C, 2D for printing four colors in the present embodiment, and can print images on the corrugated board sheets S by using four ink colors (for example, cyan, magenta, yellow, and black). The print units 2A, 2B, 2C, 2D are configured likewise, and each one includes a printing cylinder 21, an ink supply roll 22, an ink chamber 23, and a receiving roll 24. The printing cylinder 21 includes a printing plate 25 mounted at its outer periphery, and is provided rotatably. The ink supply roll 22 is arranged to abut on the printing plate near the printing cylinder 21, and is provided rotatably. The ink chamber 23 stores therein ink, and is provided near the ink supply roll 22. The receiving roll 24 sandwiches each corrugated board sheet S with the printing cylinder 21, and conveys it, and is provided rotatably facing the downward of the printing cylinder 21. Upper and lower sending rolls 26 are provided downstream of the printing cylinder 21 and the receiving roll 24 in the conveyance direction D.

The slotter creaser 3 performs creasing process and also slotting process on the corrugated board sheets S. The slotter creaser 3 includes a pair of upper and lower creasing heads 31, 32, and a pair of upper and lower slotter heads 33, 34. The creasing heads 31, 32 are formed circularly, and are provided rotatably about a shaft of a roll axis 35 arranged in the horizontal direction orthogonal to the conveyance direction D of the corrugated board sheets S. Urethane or the like is fixed to the outer periphery of the creasing head 31. A protrusion for forming creasing lines is provided to the outer periphery of the lower creasing head 32. On the other hand, the slotter heads 33, 34 are formed circularly, and are provided rotatably about a shaft of a slotter axis 36 arranged in the horizontal direction orthogonal to the conveyance direction D of the corrugated board sheet S. Two slotter knives 33A are fixed to the outer periphery of the upper slotter head 33. A receiving blade that receives the slotter knife 33A is provided to the outer periphery of the lower slotter head 34. Upper and lower conveying rolls 37 are provided between the creasing heads 31, 32 and the slotter heads 33, 34. A plurality, four pairs in the present embodiment, of the creasing heads 31, 32 and the slotter heads 33, 34 are provided in the axis directions of the axes 35, 36.

The folding unit 4 manufactures the flat corrugated board boxes B by folding the corrugated board sheets S being moved in the conveyance direction D, and jointing both ends. The folding unit 4 includes a guide rail 41 that guides the corrugated board sheet S along the conveyance direction D, and a conveying belt 42 that circulates along the conveyance direction D of the corrugated board sheet S above the guide rail 41. The folding unit 4 includes a glue applying device 43, a folding bar 44, and a folding belt 45 disposed in this order along the conveyance direction D of the corrugated board sheet S conveyed by the guide rail 41 and the conveying belt 42.

The nonconforming product removing unit 5 is a nonconforming product removing apparatus according to the present invention, and sorts out conforming products and nonconforming products based on conformity of joints of the corrugated board boxes B conveyed from the folding unit 4. The nonconforming product removing unit 5 includes, as explained in detail below, a conveying unit 51 that conveys the corrugated board box B from the folding unit 4 to the counter ejector 6, a joint detecting unit 52 that detects the dimension of a gap of a joint of each corrugated board box B conveyed by the conveying unit 51, a sort-out unit 53 that sorts out conforming products and nonconforming products based on conformity judgment of a joint in a detection result of the corrugated board box B, and a receiving unit 54 that receives the nonconforming corrugated board box B sorted out.

The counter ejector 6 stacks the corrugated board boxes B, sorts them into a predetermined number of batches, and then discharges them. The counter ejector 6 includes upper and lower pressing rolls 61 and a hopper device 62. The hopper device 62 includes an elevator 63 that can be lifted and lowered on which the corrugated board boxes B are stacked, and the elevator 63 includes a butting plate 64 and an angle fixing plate 65 as reshaping units. A discharging conveyer 66 is provided below the elevator 63.

Operation performed by the thus configured box making machine is explained. As shown in FIG. 2, in each corrugated sheet S, a waveform corrugated medium 103 is formed between a bottom liner 101 and a liner 102 by applying glue thereto. Folding lines 201, 202 are formed on the corrugated board sheet S at a preceding step of the box making machine. The folding lines 201, 202 are for folding flaps when assembling the corrugated board boxes B manufactured by the box making machine afterwards. The corrugated board sheets S are stacked on the table 11 of the paper feeding unit 1 as shown in FIG. 1.

In the paper feeding unit 1, the kicker 12 that is reciprocated by the crank lever mechanism 13 kicks off the lowermost corrugated board sheets S stacked on the table 11 one by one, and sends them out to the feeding roll 14. The upper and the lower feeding rolls 14 rotating at a constant speed sandwich a single corrugated board sheet S kicked off by the kicker 12, and pull it off to the printing unit 2 in the conveyance direction shown in FIG. 2.

In the printing unit 2, the print unit 2A (2B, 2C, 2D) supplies ink from the ink chamber 23 to the front surface of the ink supply roll 22, and when the printing cylinder 21 and the ink supply roll 22 rotate, the ink on the front surface of the ink supply roll 22 is transferred to the printing plate 25. When the corrugated board sheet S is conveyed between the printing cylinder 21 and the receiving roll 24, images are printed on the front surface of the corrugated board sheet S being sandwiched by the printing plate 25 and the receiving roll 24. The corrugated board sheet S after printing is conveyed while being sandwiched by the outer peripheries of the printing cylinder 21 and the receiving roll 24, and is conveyed by a sending roll 26 to the next print unit 2B (2C, 2D). The corrugated board sheet S on which images are printed by the print unit 2D is conveyed by the sending roll 26 to the slotter creaser 3.

In the slotter creaser 3, when the corrugated board sheet S passes the upper and the lower creasing heads 31, 32, creased lines 301, 302, 303, 304 are formed by a protrusion of the lower creasing head 32 on the back surface side of the corrugated board sheet S, that is on the side of the liner 102, as shown in FIG. 3. The corrugated board sheet S on which the creased lines 301, 302, 303, 304 are formed is conveyed by the conveying roll 37, and when it passes the upper and the lower slotter heads 33, 34, slots 401, 402, 403 and a glue application tab 404 are formed as shown in FIG. 3. The corrugated board sheet S on which the creased lines 301, 302, 303, 304, the slots 401, 402, 403, and the glue application tab 404 are formed is conveyed to the folding unit 4.

In the folding unit 4, after glue is applied by the glue applying device 43 to the back surface side of the glue application tab 404, that is on the side of the back liner 102, of the corrugated board sheet S supported by the guide rail 41 and the conveying belt 42 being moved in the conveyance direction D, the creased lines 301, 303 are folded downward by the folding bar 44 as shown in FIG. 4. When they are folded nearly up to 180°, a folding belt 45 further acts thereon to strengthen the folding force, the glue application tab 404 and an end of the corrugated board sheet S that overlaps the glue application tab 404 are pressed to adhere with each other, and both ends of the corrugated board sheet S are jointed to form the corrugated board box B as shown in FIG. 5. The manufactured corrugated board box B is conveyed to the nonconforming product removing unit 5. Two gaps 405 are formed at the joint of the corrugated board box B manufactured by the folding unit 4 as shown in FIG. 5.

In the nonconforming product removing unit 5, the dimension of the gaps 405 of the joint of the corrugated board box B conveyed by the conveying unit 51 are detected by the joint detecting unit 52. In the nonconforming product removing unit 5, the corrugated board box B judged as a conforming product in the detection result of the dimension of the gaps 405 passes the sort-out unit 53, and is conveyed directly to the counter ejector 6. On the other hand, the corrugated board box B judged as a nonconforming product is separated from the conveying unit 51 by the sort-out unit 53, and is conveyed to the receiving unit 54.

In the counter ejector 6, the corrugated board box B detected as a conforming product is sent to the hopper device 62 by the pressing roll 61. The corrugated board box B sent to the hopper device 62 is staked on the elevator 63 after hitting the front stopper 64 at its leading end in the conveyance direction D, and being reshaped by the angle fixing plate 65. When a predetermined number of such corrugated board boxes B is stacked on the elevator 63, the elevator 63 goes down, and the predetermined number of the corrugated board boxes B is discharged as a single batch by the discharging conveyer 66, and is sent to a following step of the box making machine.

The detail of the nonconforming product removing apparatus used in the box making machine is explained. The nonconforming product removing apparatus in the present embodiment is the nonconforming product removing unit 5, and is arranged between the folding unit 4 and the counter ejector 6. The nonconforming product removing unit 5 mainly includes the conveying unit 51, the joint detecting unit 52, the sort-out unit 53 and the receiving unit 54.

The conveying unit 51 includes upper and lower conveying belts 511, 512 (512A, 512B, 512C, 512D) as shown in FIGS. 6 and 7. A conveyance path is formed between the upper and the lower conveying belts 511, 512, and the upper and the lower conveying belts 511, 512 sandwich the corrugated board box B manufactured by the folding unit 4, and circulate to convey the corrugated board box B from the folding unit 4 to the counter ejector 6.

The upper conveying belt 511 is supported, in a loop form, by a plurality of rollers 513 arranged horizontally with their shafts orthogonal to the conveyance direction D of the corrugated board box B, and its lower part extends substantially horizontally. A plurality (eight in the present embodiment) of the upper conveying belt 511 includes predetermined intervals therebetween in the direction of shafts of the rollers 513. The upper conveying belt 511 circulates with the rollers 513 being rotated by a driving motor 511A (see FIG. 9). A suction box 514 is provided in the loop form of the upper conveying belt 511. The suction box 514 is arranged along the lower part of the upper conveying belt 511, and by running a suction device 514A (see FIG. 9) inside, suctions the corrugated board box B to the outer periphery of the lower part of the upper conveying belt 511.

A plurality of the lower conveying belt 512 is provided along the conveyance direction D of the corrugated board box B in the order of the lower conveying belts 512A, 512B, 512C, 512D. The lower conveying belts 512A, 512B, 512C, 512D are supported, in loop forms, by a plurality of rollers 515 arranged horizontally with their shafts orthogonal to the conveyance direction D of the corrugated board box B, and their upper parts extend substantially horizontally. A plurality of the lower conveying belts 512A, 512B, 512C, 512D is provided with predetermined intervals therebetween in the direction of shafts of the rollers 515 (five of the lower conveying belts 512A, 512B, 512C, and six of the lower conveying belts 512D in the present embodiment). The lower conveying belts 512A, 512B, 512C, 512D circulate with the rollers 515 being rotated by a driving motor 512E (see FIG.

9). A pressing device 516 is provided in the loop forms of the lower conveying belts 512B, 512C, 512D. The pressing device 516 presses the outer periphery of the upper parts of the lower conveying belts 512B, 512C, 512D against the corrugated board box B by pressing the upper parts of the lower conveying belts 512B, 512C, 512D upward.

The joint detecting unit 52 is provided in the lower range of the conveying unit 51 as shown in FIG. 6, and includes a light source 521, a camera (an imaging unit) 522, and a positioning device 523. The light source 521 irradiates the joint of the corrugated board box B passing a conveyance path with light (laser), and in the present embodiment, irradiates the joint of the corrugated board box B passing between the lower conveying belt 512A and the lower conveying belt 512B with light. The camera 522 is for imaging the joint of the corrugated board box B receiving light emitted from the light source 521. In the joint detecting unit 52, the dimension of the gaps 405 of the joint of the corrugated board box B imaged by the camera 522 are detected. The positioning device 523 supports the light source 521 and the camera 522 integrally and is provided movably in the horizontal direction orthogonal to the conveyance direction D of the corrugated board box B. The corrugated board box B manufactured by the box making machine has various sizes, and the position of its joint differs depending on the size. Accordingly, the joint is precisely irradiated with light, and the joint can be imaged by moving the light source 521 and the camera 522 by the positioning device 523.

The sort-out unit 53 is provided between the lower conveying belt 512C and the lower conveying belt 512D of the conveying unit 51 as shown in FIG. 6, and includes, as supporting members, a selective conveying belt 531 (531A, 531B), a first separating mechanism 532, and a second separating mechanism 533.

Figure 12:
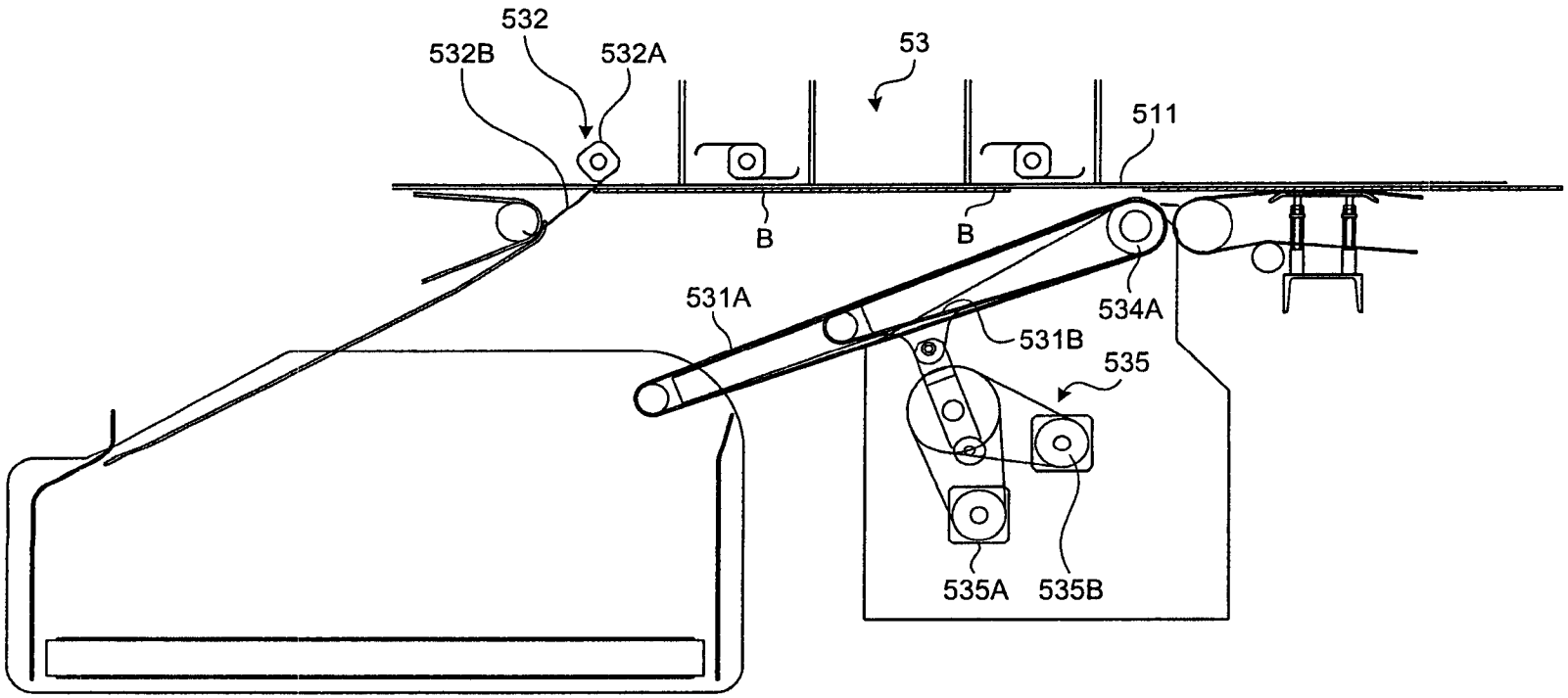
FIG. 12 is a schematic of operation performed by a nonconforming product removing apparatus.

The selective conveying belt 531 is supported, in a loop form, by a pair of rollers 534A, 534B arranged horizontally with their shafts orthogonal to the conveyance direction D, and includes the roller 534A disposed upstream in the conveyance direction D as a base end, and the other roller 534B disposed downstream as a free end. The selective conveying belt 531 includes a plurality (two in the present embodiment) of the selective conveying belts 531A, 531B having different lengths from the base ends to the free ends in the conveyance direction D of the corrugated board box B. In the present embodiment, the selective conveying belt 531A is long, and the selective conveying belt 531B is short. The selective conveying belts 531A, 531B are provided swingably vertically about the shaft of the roller 534A on the base end side disposed upstream of the conveyance direction D of the corrugated board box B. The positions between which the selective conveying belts 531A, 531B swing are a conveyance position at which the selective conveying belts 531A, 531B are along the bottom surface of the corrugated board box B conveyed by the conveying unit 51 as shown in FIG. 6, which position is for supporting the conveyance of the corrugated board box B to the counter ejector 6 and a discharge position at which the selective conveying belts 531A, 531B tilted downward and are separated from the upper conveying belt 511 as shown in FIG. 12, which position is for discharging the corrugated board box B from the conveyance path.

The swing of the selective conveying belts 531A, 531B are driven by a swinging mechanism 535. The swinging mechanism 535 is configured by a crank mechanism linked to the selective conveying belts 531A, 531B, and converts rotary movement transmitted from the driving motors 535A, 535B into reciprocation. Accordingly, the selective conveying belts 531A, 531B independently reciprocate between the conveyance position and the discharge position due to the swinging mechanism 535.

The selective conveying belts 531A, 531B circulate with the roller 534A being rotated by the driving motor 536 shown in FIG. 8.

The selective conveying belt 531 (531A, 531B) is supported integrally with the swinging mechanism 535 and the driving motor 536 by the frame 537 as shown in FIGS. 6 and 8. The frame 537 is supported by a rail 538 extending in the horizontal direction orthogonal to the conveyance direction D of the corrugated board box B. The frame 537 is provided movably in the horizontal direction orthogonal to the conveyance direction D of the corrugated board box B along the rail 538 as indicated by a two dot chain line in FIG. 8 due to the positioning device 539 shown in FIG. 6. As explained above, the corrugated board box B manufactured by the box making machine has various sizes, and thereby the center position in the conveyance direction D differs depending on the size. Accordingly, the corrugated board box B can be supported stably by moving the selective conveying belt 531 (531A, 531B), while aligning them at the center position of the corrugated board box B by the positioning device 539.

Figure 11:
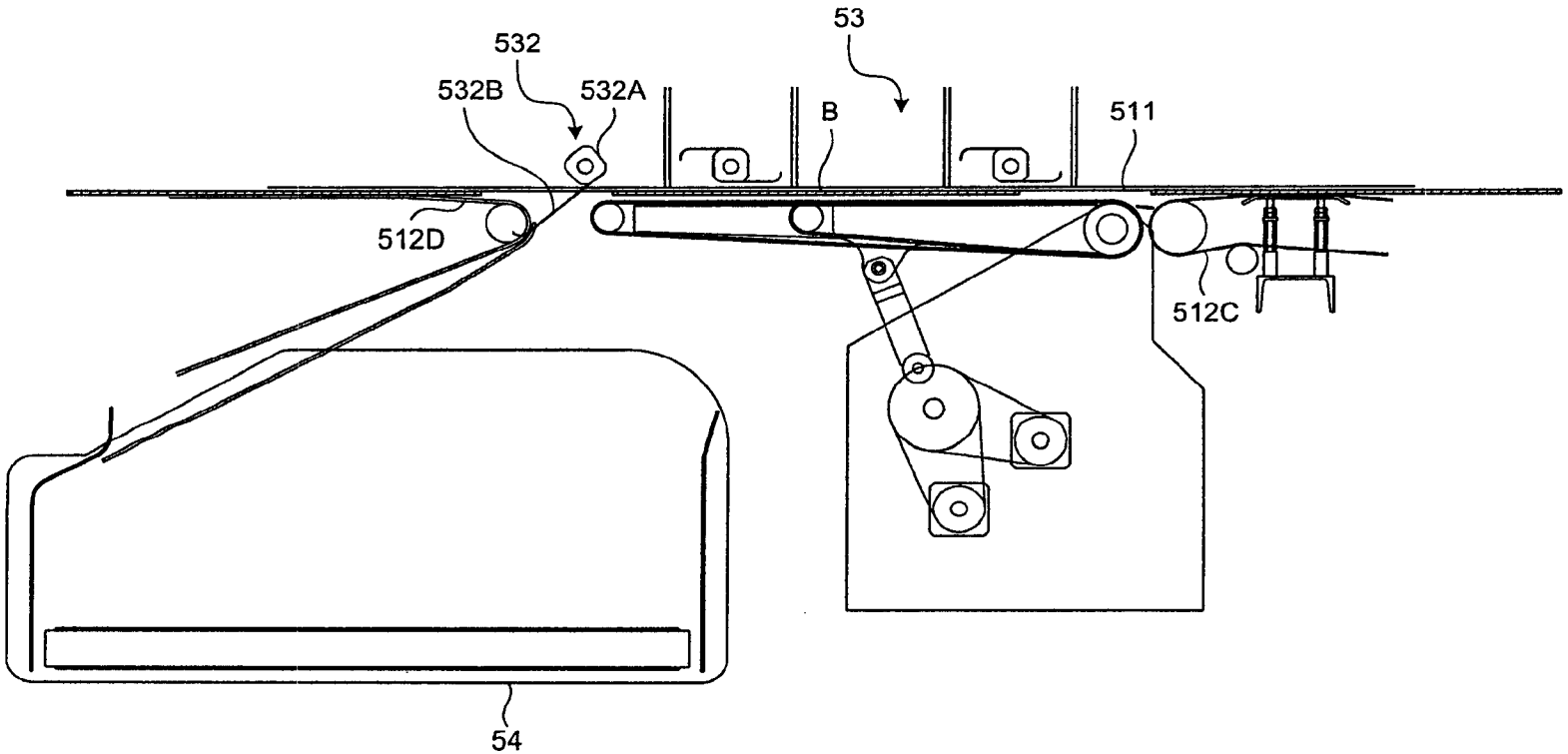
FIG. 11 is a schematic of operation performed by a nonconforming product removing apparatus.

The first separating mechanism 532 is disposed on the side of the suction box 514 as shown in FIG. 6, that is on the top surface side of the conveyed corrugated board box B, above the selective conveying belt 531. The first separating mechanism 532 includes a rotating member 532A provided rotatably about the shaft of its axis extending in the horizontal direction orthogonal to the conveyance direction D of the corrugated board box B, and a single arm member 532B extending away from the axis of the rotating member 532A. The first separating mechanism 532 moves between a stand-by position at which the arm member 532B is separated from the top surface of the corrugated board box B as shown in FIG. 6, and a protrusion position at which the arm member 532B protrudes toward the conveyance path from between the upper conveying belt 511 so as to abut on the corrugated board box B as shown in FIG. 11 with the rotating member 532A being rotated by a driving unit (not shown).

Figure 13:
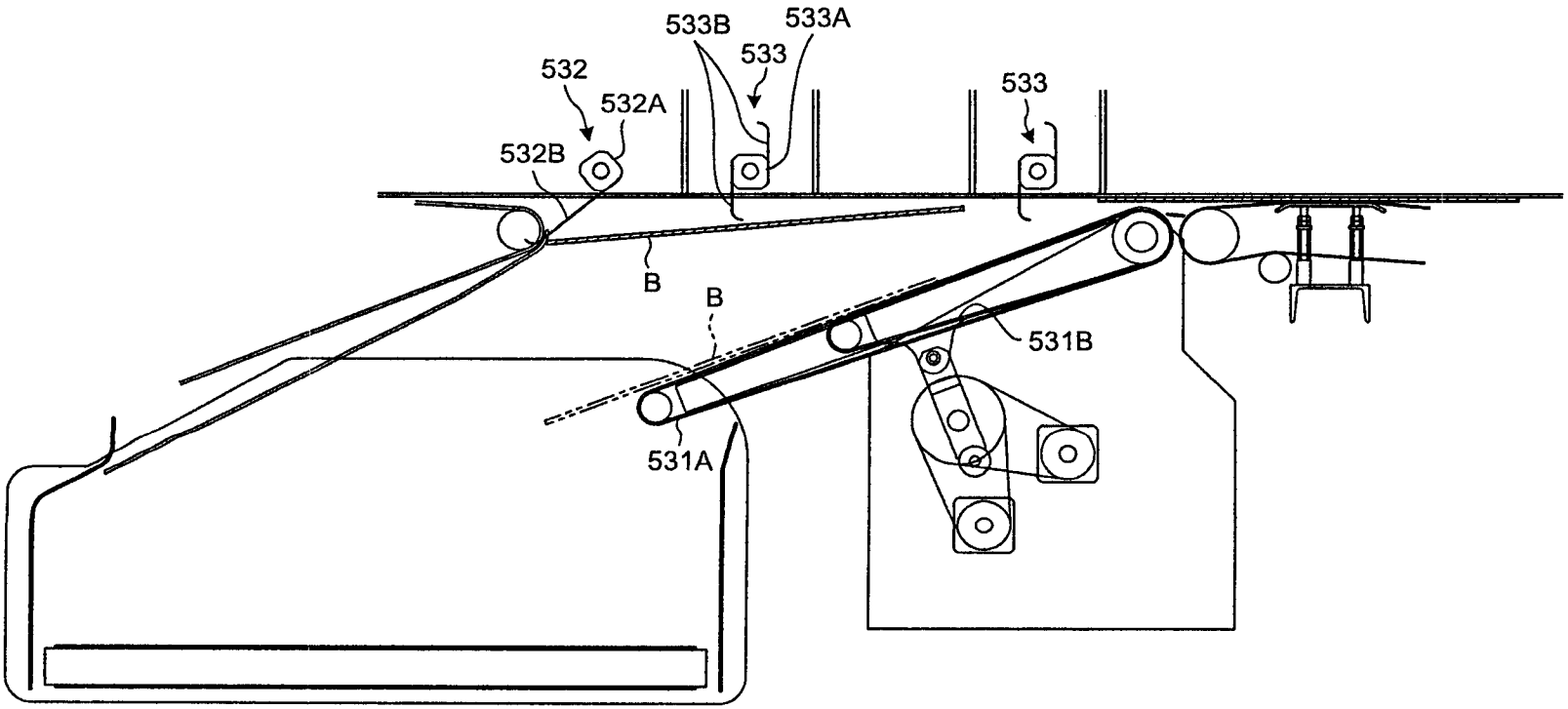
FIG. 13 is a schematic of operation performed by a nonconforming product removing apparatus.

The second separating mechanism 533 is arranged upstream of the first separating mechanism 532 in the conveyance direction D of the corrugated board box B as shown in FIG. 6, and is disposed on the side of the suction box 514, that is on the top surface side of the conveyed corrugated board box B, above the selective conveying belt 531. The second separating mechanism 533 includes a rotating member 533A provided rotatably about the shaft of its axis extending in the horizontal direction orthogonal to the conveyance direction D of the corrugated board box B, and a plurality (two in the present embodiment) of arm members 533B extending away from the axis of the rotating member 533A. The second separating mechanism 533 moves between a stand-by position at which the arm members 533B are separated from the top surface of the corrugated board box B as shown in FIG. 6, and a protrusion position at which the arm members 533B protrude toward the conveyance path from between the upper conveying belt 511 so as to abut on the corrugated board box B as shown in FIG. 13, with the rotating member 533A being rotated by a driving unit (not shown). The second separating mechanism 533 is provided at a plurality of positions (two positions in the present embodiment) along the conveyance direction D of the corrugated board box B.

The receiving unit 54 is provided at a lower range of the selective conveying belt 531 (531A, 531B) as shown in FIG. 6, and is for receiving the corrugated board box B discharged from the conveyance path. The receiving unit 54 includes a discharge conveyer 541 provided at its bottom.

A passage detecting unit 55 is provided in the conveyance path formed by the upper and the lower conveying belts 511, 512. The passage detecting unit 55 is for detecting passage of the corrugated board box B conveyed by the conveying unit 51, and uses, for example, a photo cell sensor that detects passage of the corrugated board box B when irradiated light is blocked. The passage detecting unit 55 is provided downstream of the joint detecting unit 52 in the conveyance direction D of the corrugated board box B, and provided in the present invention to detect passage of the corrugated board box B between the lower conveying belt 512B and the lower conveying belt 512C.

The control system of the nonconforming product removing unit 5 is explained. As shown in FIG. 9, the nonconforming product removing unit 5 includes a controlling device 56 configured by a microcomputer or the like. The controlling device 56 includes a drive controlling unit 57. A memory unit 58 and a judging unit 59 are connected to the drive controlling unit 57. The driving motor 511A of the upper conveying belt 511, the driving motor 512E of the lower conveying belt 512, the suction device 514A, the driving motors 536, 535A, 535B of the selective conveying belt 531, the first separating mechanism 532, the second separating mechanism 533, the discharging conveyer 541, the joint detecting unit 52, and the passage detecting unit 55 are connected to the drive controlling unit 57. The drive controlling unit 57 controls the nonconforming product removing unit 5 according to a computer program and data stored in the memory unit 58, and particularly judgment information acquired from the judging unit 59.

The memory unit 58 stores therein a threshold for judging conformity of the joint of the corrugated board box B. Specifically, the dimension of the gaps 405 of the joint of the corrugated board box B shown in FIG. 5 is stored in the memory unit 58 as the threshold. For example, the proper dimension as the conforming product of the manufactured corrugated board box B is 6 millimeters±3 millimeters (3 millimeters to 9 millimeters) at its gaps 405, and within 3 millimeters as the dimensional difference of the two gaps 405. The memory unit 58 stores therein the proper dimension (reference interval) as the threshold. The proper dimension of the gaps 405 of the corrugated board box B is a dimension before the corrugated board box B is reshaped by the reshaping units (the butting plate 64 and the angle fixing plate 65) of the counter ejector 6, and is set based on prediction from the dimension of the gaps 405 of the joint of the conforming corrugated board box B after being reshaped by the reshaping units. This is because, in the present embodiment, the nonconforming product removing unit 5 is provided between the folding unit 4 and the counter ejector 6, the dimension of the gaps 405 of the joint of the corrugated board box B before being reshaped by the counter ejector 6 is detected by the joint detecting unit 52, and the conformity of the joint of the corrugated board box B is judged based on the dimension of the gaps 405 detected by the joint detecting unit 52.

The judging unit 59 compares the dimension of the gaps 405 of the joint of the corrugated board box B acquired by the joint detecting unit 52 with the reference interval acquired by the memory unit 58, and judges the corrugated board box B to be conforming when the detected dimension is within the reference interval. On the other hand, when the detected dimension is out of the reference interval, the corrugated board box B is judged to be nonconforming.

Control of the nonconforming product removing unit 5 by the drive controlling unit 57 of the controlling device 56 is explained with reference to FIGS. 6 and 10 to 15.

The drive controlling unit 57 drives the driving motor 511A of the upper conveying belt 511, the driving motor 512E of the lower conveying belt 512, the suction device 514A, and the driving motor 536 of the selective conveying unit 531 to convey the corrugated board box B from the folding unit 4 to the counter ejector 6 (Step S1). At this time, the corrugated board box B is pressed against the lower part of the upper conveying belt 511 by the pressing device 516, and is conveyed while being sandwiched between the upper conveying belt 511 and the lower conveying belts 512B, 512C, 512D. Accordingly, the adhered joint is prevented from being peeled off even when the glue applied by the folding unit 4 is undried, and furthermore meandering traveling of the corrugated board box B is prevented. As a result, the dimension of the gaps 405 can be detected accurately by the joint detecting unit 52. Normally, the selective conveying belt 531 (531A, 531B) is at the conveyance position as shown in FIG. 6. The first separating mechanism 532 and the second separating mechanism 533 stand by when they lie in the arm members 532B and 533B, respectively, as shown in FIG. 6.

As shown in FIG. 6, the dimension of the gaps 405 of the corrugated board box B being conveyed is detected by the joint detecting unit 52 (Step S2). The drive controlling unit 57 outputs the threshold of the proper dimension stored in the memory unit 58, and the dimension acquired by the joint detecting unit 52 to the judging unit 59. The judging unit 59 compares the threshold with the dimensional information to judge conformity of the joint of the corrugated board box B. The drive controlling unit 57 acquires the judgment result obtained by the judging unit 59 (Step S3).

When the judgment result obtained by the judging unit 59 indicates a nonconforming product (YES at Step S4), the drive controlling unit 57 acquires the leading end position of the conveyed nonconforming corrugated board box B in the conveyance direction D based on a drive pulse of the driving motor 511A of the upper conveying belt 511, and a detection signal from the passage detecting unit 55 as shown in FIG. 6 (Step S5).

When the leading end position of the conveyed nonconforming corrugated board box B in the conveyance direction D reaches a position just before the first separating mechanism 532 as shown in FIG. 11, the drive controlling unit 57 rotates the rotating member 532A of the first separating mechanism 532 by, for example, 40°, and moves the arm member 532B from the horizontal position to the protrusion position at which the arm member 532B protrudes to the conveyance path (Step S6).

When the leading end position of the conveyed nonconforming corrugated board box B in the conveyance direction D reaches a position at which the leading end abuts on the arm member 532B of the first separating mechanism 532 as shown in FIG. 12, the drive controlling unit 57 drives the driving motors 535A, 535B, and moves the selective conveying belt 531 (531A, 531B) to the discharge position. Along with the movement of the selective conveying belt 531 (531A, 531B), the drive controlling unit 57 continuously rotates the rotating member 533A of the second separating mechanism 533 as shown in FIG. 13, and makes the arm members 533B protrude toward the conveyance path (Step S7).

Accordingly, the nonconforming corrugated board box B suctioned and conveyed by the upper conveying belt 511 is flapped by the arm members 533B of the second separating mechanism 533 as the corrugated board box B abuts on the arm member 532B of the first separating mechanism 532 at its leading end as shown in FIG. 13, and is separated from the upper conveying belt 511. Accordingly, the nonconforming corrugated board box B falls on the selective conveying belt 531 (531A, 531B) at the discharge position as indicated by a chain double-dashed line in FIG. 13.

Figure 14:
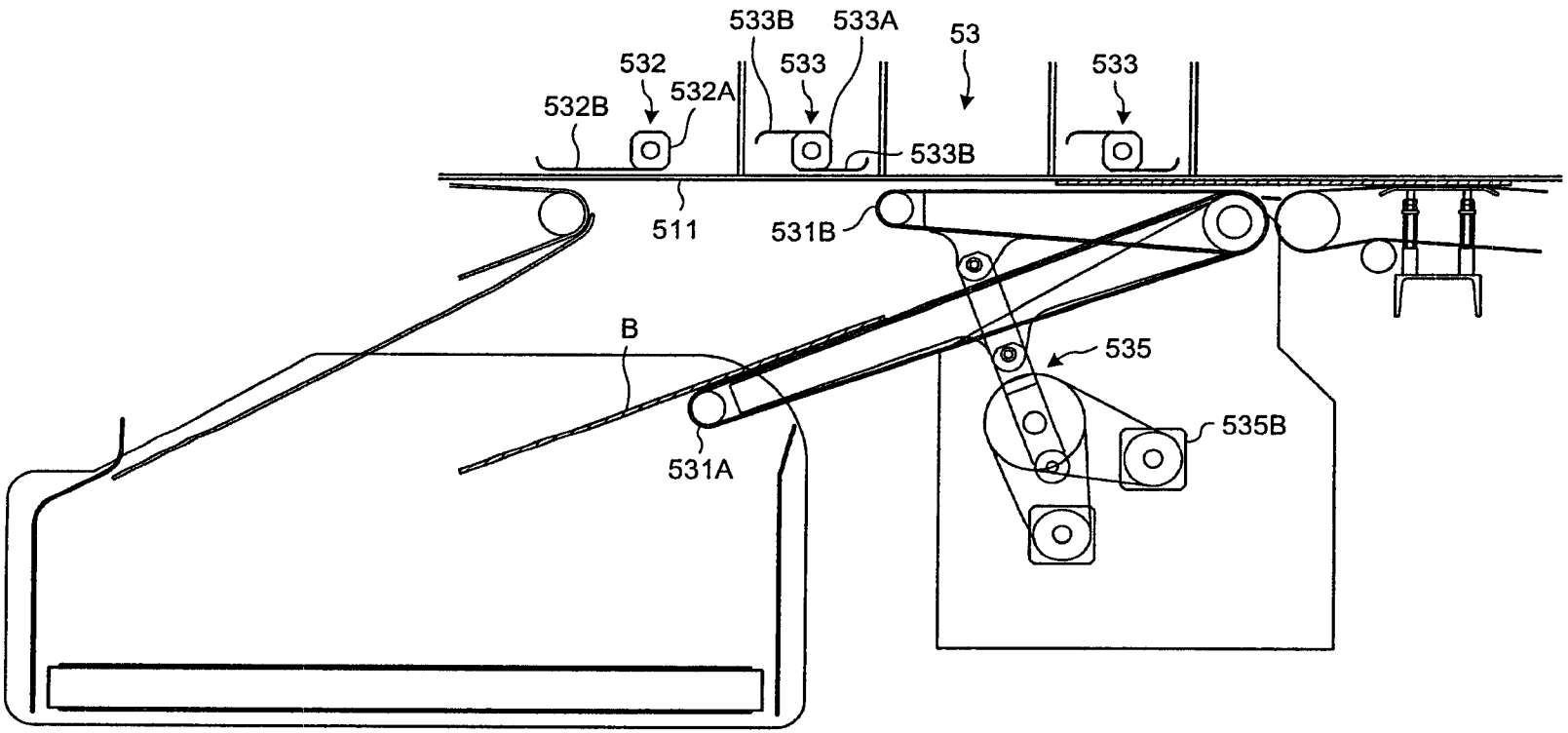
FIG. 14 is a schematic of operation of nonconforming product removing apparatus.

When the nonconforming corrugated board box B having fallen passes above the short selective conveying belt 531B as shown in FIG. 14, the drive controlling unit 57 drives the driving motor 535B, and moves only the selective conveying belt 531B to the conveyance position. Simultaneously, the drive controlling unit 57 rotates the arm members 532A, 532B of the first separating mechanism 532 and the second separating mechanism 533, and returns the arm members 532B, 533B to the stand-by position (Step S8). Accordingly, the corrugated board box B conveyed next to the nonconforming corrugated board box B can be supported by the selective conveying belt 531B moved to the conveyance position; thereby, conveyance intervals of the corrugated board box B can be shortened to increase the manufacturing process speed.

Figure 15:
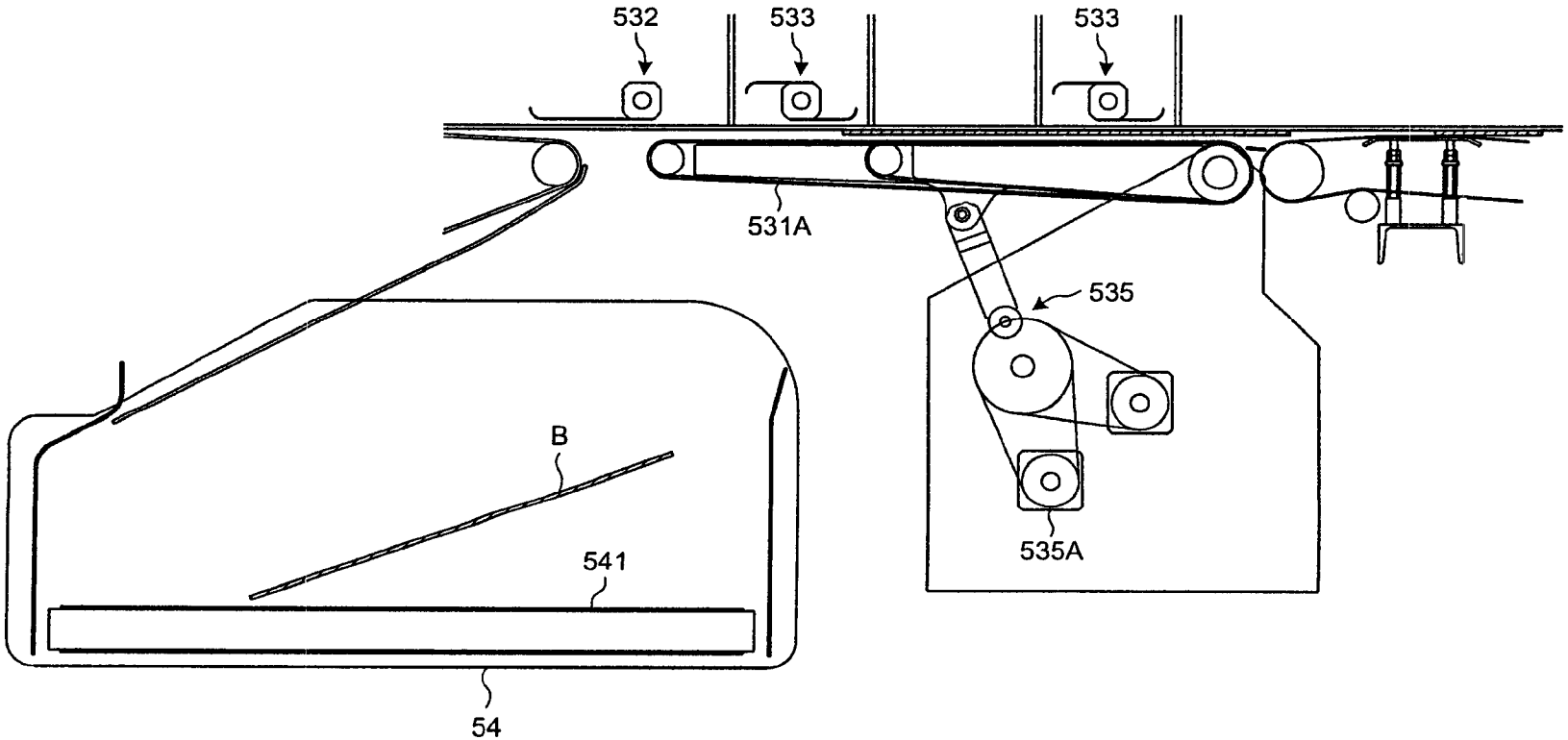
FIG. 15 is a schematic of operation performed by a nonconforming product removing apparatus.

When the nonconforming corrugated board box B having fallen passes above the long selective conveying belt 531A as shown in FIG. 15, the drive controlling unit 57 drives the driving motor 535A and moves the selective conveying belt 531A to the conveyance position (Step S9). The nonconforming corrugated board box B is received by the receiving unit 54, and discharged by the discharging conveyer 541.

On the other hand, when the judgment result obtained by the judging unit 59 indicates a conforming product (NO at Step S4), the drive controlling unit 57 leaves the selective conveying belt 531 (531A, 531B) at the conveyance position, leaves the arm members 532B, 533B of the first separating mechanism 532 and the second separating mechanism 533 at the stand-by position, and conveys the conforming corrugated board box B to the counter ejector 6 (Step S10).

As can be seen, according to the nonconforming product removing unit 5, the nonconforming product removing unit 5 is disposed between the folding unit 4 and the counter ejector 6 of the box making machine, and includes the sort-out unit 53 that conveys a corrugated board box B whose joint is judged to be good by the judging unit 59 to the counter ejector 6, and on the other hand discharges a corrugated board box B whose joint is judged to be bad by the judging unit 59. Accordingly, only the conforming corrugated board box B can be conveyed to the counter ejector 6. Therefore, the nonconforming board box B can be removed easily, without requiring complicated work of taking out the nonconforming corrugated board box B from among corrugated board boxes B sorted into a predetermined number of batches by the counter ejector 6, and re-sorting only the conforming corrugated board boxes B into a predetermined number of batches.

The judging unit 59 judges the conformity of a box before reshaping by comparing the dimension (reference interval) of the gaps 405 of the joint of the box before reshaping as set based on prediction from the dimension of the gaps 405 of the joint of the box reshaped by the reshaping units (the butting plate 64 and the angle fixing plate 65) of the counter ejector 6, and the judgment result obtained by the joint detecting unit. Accordingly, even when the nonconforming product removing unit 5 is disposed between the folding unit 4 and the counter ejector 6 of the box making machine, the conformity of the corrugated board box B can be judged accurately.

The sort-out unit 53 includes a plurality of the selective conveying belts 531A, 531B having different lengths in the conveyance direction D. The selective conveying belts 531A, 531B are movable between the conveyance direction along the bottom surface of the corrugated board box B conveyed from the folding unit 4 to the counter ejector 6, and the discharge position at which the selective conveying belts 531A, 531B tilted downward above the same shafts disposed upstream in the conveyance direction D. When the nonconforming corrugated board box B is discharged, the selective conveying belts 531A, 531B are simultaneously moved to the discharge position, and are moved to the conveyance direction starting with the selective conveying belt 531B along with passage of the corrugated board box B. Accordingly, the corrugated board box B conveyed next to the nonconforming corrugated board box B can be supported by the selective conveying belt 531B having been moved to the conveyance position previously; thereby, the conveyance intervals of the corrugated board box B can be shortened to increase the manufacturing process speed.

In the box making machine including the nonconforming product removing unit 5, the nonconforming corrugated board box B can be easily removed, and even when the nonconforming product removing unit 5 is disposed between the folding unit 4 and the counter ejector 6, the conformity of the corrugated board box B can be judged precisely. Furthermore, the conveyance intervals of the corrugated board box B can be shortened to increase the manufacturing process speed.

In the present embodiment, although the memory unit 58 stores therein the proper dimension of a conforming product (the dimension of the gaps 405 being 6 millimeters±3 millimeters (3 millimeters to 9 millimeters), and the dimensional difference between the two gaps 405 being within 3 millimeters) as the reference interval, the reference interval is not limited to this. For example, the memory unit 58 may store therein the dimensional range of a nonconforming product as the reference interval, and the judging unit 59 may judge the corrugated board box B as a nonconforming product when the dimensional range of the nonconforming product matches with a dimension detected by the joint detecting unit 52. The reference interval of the nonconforming product is also a dimension before the corrugated board box B is reshaped by the reshaping units (the butting plate 64 and the angle fixing plate 65) of the counter ejector 6, and is set based on prediction from the dimension of the gaps 405 of the joint of the conforming corrugated board box B after being reshaped by the reshaping units.

In the present embodiment, although the inspection item for judging the conformity of the corrugated board box B is the dimension of the gaps 405 of a joint, and the joint detecting unit 52 that detects the dimension of the gaps 405 is applied, the inspection item is not limited to this. For example, the inspection item may be whether the corrugated board sheet S is conveyed at equal intervals (conveyance interval of the corrugated board sheets S), whether the corrugated board sheet S is not fed obliquely (feeding angle of the corrugated board sheet S), whether images are printed at correct positions (printing positions of the corrugated board sheet S), whether the front-back arrangement of the corrugated board sheet S is correct (front-back arrangement of the corrugated board sheet S), or whether a cut for opening the assembled corrugated board box B is present (presence of a box opening cut). As shown in FIG. 1, these inspection items can be detected by disposing a detecting unit 38 downstream of for example the slotter creaser 3. Other inspection items include whether glue is applied properly to the glue application tab 404 (glue-application state), or whether scrapes or the like are attached to the glue application tab 404 (attachment of dust to a glue-applied part). As shown in FIG. 1, these inspection items can be detected by disposing a detecting unit 46 in the folding unit 4. In the present embodiment, the detecting units 38, 46, 52 that detect the inspection items are collectively called the inspection item detecting unit. The judging unit 59 judges conformity of the corrugated board sheet S or the corrugated board box B depending on the detection result of the inspection items obtained by the inspection item detecting unit.

INDUSTRIAL APPLICABILITY

As can be seen, the nonconforming product removing apparatus for use with a box making machine, and the box making machine according to the present invention are useful in detecting and removing a nonconforming product of a formed box, and in particular is suited for removing a nonconforming box easily.

The invention claimed is:

1. A nonconforming product removing apparatus for a box making machine including a folding unit that folds a sheet material to joint ends and form a box, and a counter ejector that discharges such boxes in a predetermined number, the nonconforming product removing apparatus comprising:

an inspection item detecting unit that performs detection depending on an inspection item of the sheet material or the box;

a judging unit that judges conformity of the sheet material or the box depending on a detection result obtained by the inspection item detecting unit; and a sort-out unit that is disposed between the folding unit and the counter ejector, conveys a box judged to be a conforming product by the judging unit to the counter ejector, and discharges a box judged to be a nonconforming product by the judging unit, wherein the sort-out unit includes a first supporting member and a second supporting member having a shorter length than the first supporting member in a conveyance direction, the first supporting member and the second supporting member are pivotally mounted on a common roller disposed upstream in the conveyance direction to be individually swingable, and only the second supporting member is returned to a conveyance position from a discharge position when the conforming product has passed over the second supporting member.

2. The nonconforming product removing apparatus for a box making machine according to claim 1, wherein the inspection item detecting unit detects at least one of a conveyance interval of such boxes, a feeding angle of the box, a printing position of the box, a front-back arrangement of the box, presence of a box opening cut, a glue-application state, and attachment of dust to a glue-applied part.

3. The nonconforming product removing apparatus for a box making machine according to claim 1, wherein the counter ejector includes a reshaping unit that reshapes a box, the inspection item detecting unit forms a joint detecting unit that detects a dimension of a gap of a joint of the box before reshaping, and the judging unit compares a reference interval of a joint of the box before reshaping as set based on prediction from the box after reshaping with a detection result obtained by the joint detecting unit, and judges conformity of the box before reshaping.

4. The nonconforming product removing apparatus for a box making machine according to claim 1, wherein when a box judged to be a nonconforming product is discharged, the supporting members are moved simultaneously to the discharge position.

5. A box making machine including a folding unit that folds a sheet material to joint ends and form a box, a counter ejector that discharges such boxes in a predetermined number, and a nonconforming product removing apparatus comprising:

an inspection item detecting unit that performs detection depending on an inspection item of the sheet material or the box;

a judging unit that judges conformity of the sheet material or the box depending on a detection result obtained by the inspection item detecting unit; and a sort-out unit that is disposed between the folding unit and the counter ejector, conveys a box judged to be a conforming product by the judging unit to the counter ejector, and discharges a box judged to be a nonconforming product by the judging unit, wherein the sort-out unit includes a first supporting member and a second supporting member having a shorter length than the first supporting member in a conveyance direction, the first supporting member and the second supporting member are pivotally mounted on a common roller disposed upstream in the conveyance direction to be individually swingable, and only the second supporting member is returned to a conveyance position from a discharge position when the conforming product has passed over the second supporting member.

6. The box making machine according to claim 5, wherein the inspection item detecting unit detects at least one of a conveyance interval of such boxes, a feeding angle of the box, a printing position of the box, a front-back arrangement of the box, presence of a box opening cut, a glue-application state, and attachment of dust to a glue-applied part.

7. The box making machine according to claim 5, wherein the counter ejector includes a reshaping unit that reshapes a box, the inspection item detecting unit forms a joint detecting unit that detects a dimension of a gap of a joint of the box before reshaping, and the judging unit compares a reference interval of a joint of the box before reshaping as set based on prediction from the box after reshaping with a detection result obtained by the joint detecting unit, and judges conformity of the box before reshaping.

8. The box making machine according to claim 5, wherein when a box judged to be a nonconforming product is discharged, the supporting members are moved simultaneously to the discharge position.

* * * * *